United States Patent [19]

Young

[11] Patent Number: 4,492,938

[45] Date of Patent: Jan. 8, 1985

[54] SYMMETRICALLY-CONFIGURED VARIABLE RATIO POWER COMBINER USING SEPTUM POLARIZER AND QUARTERWAVE PLATE

[75] Inventor: Lock R. Young, Palm Bay, Fla.

[73] Assignee: Harris Corporation, Melbourne, Fla.

[21] Appl. No.: 420,887

[22] Filed: Sep. 21, 1982

[51] Int. Cl.[3] ..... H01P 5/04; H01P 5/18

[52] U.S. Cl. ..... 333/111; 333/137; 333/21 A

[58] Field of Search ..... 333/21 A, 111, 113, 333/117, 122, 125, 137

[56] References Cited

U.S. PATENT DOCUMENTS

| | | | |
|---|---|---|---|
| 2,970,284 | 1/1961 | Goubau | 333/34 |
| 3,109,996 | 11/1963 | Allen | 333/21 R X |
| 3,588,751 | 6/1971 | Paine | 333/21 A X |
| 3,668,567 | 6/1972 | Rosen | 333/21 A |
| 4,310,813 | 1/1982 | Yuuki et al. | 333/21 A X |

OTHER PUBLICATIONS

Chen et al., *A Wide-Band Square-Waveguide Array Polarizer,* IEEE Trans. on AP, May 1973, pp. 389-391.

*Primary Examiner*—Paul L. Gensler

*Attorney, Agent, or Firm*—Antonelli, Terry & Wands

[57] ABSTRACT

A variable ratio power combiner employs, as its major coupling component, one or more septum polarizers and associated 90° differential phase shifters or quarter waveplates in place of conventional OMTs. Advantageously, a septum polarizer is a relatively simple component that serves the same function as an OMT and polarizer combination. Because it has an essentially T-shaped configuration, it can bring a pair of waveguide arms together in the same plane back-to-back, so that the resulting power combiner may provide the desired symmetrical coupling. Normally the variable ratio power combiner requires only symmetrical inputs for the sources and not both symmetrical inputs and outputs, so that only a single septum polarizer and associated quarter waveplate are employed, with an OMT used for the output. For a completely symmetrical configuration, however, the other OMT may be replaced by a separate septum polarizer/rotatable quarter waveplate arrangement.

26 Claims, 4 Drawing Figures

SYMMETRICALLY-CONFIGURED VARIABLE RATIO POWER COMBINER USING SEPTUM POLARIZER AND QUARTERWAVE PLATE

FIELD OF THE INVENTION

The present invention relates to microwave coupling devices and is particularly directed to an arrangement capable of operating as a power combiner and variable directional coupler, while offering compact and symmetrical packing of its components.

BACKGROUND OF THE INVENTION

In certain types of signal transmission environments, such as communication satellites, it is necessary to couple energy from a plurality of microwave signal sources to a single output waveguide port within the confines of a fixed waveguide system. For this purpose there have been developed various types of variable ratio power combiners which operate essentially as variable directional couplers that provide selective coupling from 0 to 100%. One type of combiner varies the angle of a linearly polarized signal in a circular waveguide with respect to an orthogonal mode transducer (OMT) terminating it, thus varying the coupling between the two output ports from 0 to 100% for either port. This has proven to be an excellent way to combine coherent high power signals, such as multiple transmitters, since the components are usually high power and low loss.

For a system requiring power combining, the two high power signals are combined so that they are in phase at the OMT junction, thus producing linear polarization in the circular waveguide. The angle of polarization is dependent upon the ratio of the powers of the two signals and the linearity of the polarization is dependent upon the phase between the two signals. In any case, the total power of the two signals is established in the circular waveguide.

If the two signals are properly phased prior to entering the OMT, the total power is combined to a single linearly polarized output signal in the circular waveguide. In order to extract that output signal, the output rectangular waveguide must be transitioned to the circular waveguide and oriented to be aligned with the signal for maximum power transfer. This transition in most cases involves the use of another OMT which provides, in its orthogonal port, a null indication of improper phase and/or misalignment. This output OMT may be physically rotated for proper alignment using two rotary joints, but in most cases it is electrically rotated via a 180° differential phase shifter or halfwave plate which is mounted between rotary joints in an arrangement as shown in FIG. 1.

Here, two signals IN1 and IN2 are applied to an OMT 11 via a pair of input ports 10 and 12 that are physically turned 90% from each other. The OMT 11 is coupled to one end of halfwave plate 14 via a rotary joint 13, while the other end of halfwave plate 14 is coupled to another OMT 17 via rotary joint 15. OMT 17 has an output termination at port 16 while the combined signal is derived from port 18. The halfwave plate 14 will cause an impressed linear polarization to rotate at its output port, as it is rotated, and the elliplicity of the output polarization is the same at the output as it was at the input. The phase of the two signal sources IN1 and IN2 at OMT 11 of the variable ratio power combiner are made identical to each other, in order to properly combine the signals over the wide bandwidths of today's transmitters. For exemplary illustrations of microwave power combiners employing the above-described coupling components, attention may be directed to the devices described in the U.S. Pat. Nos. to Bowness 3,094,676, Kolbly 3,588,751 and Rosen 3,668,567.

Now although the above-mentioned conventional coupling schemes provide, in a purely electrical functional sense, the sought-after signal combining of the outputs of a pair of microwave energy sources, their physical configuration leaves much to be desired, since complicated and bulky waveguides runs are required for attachment to the 90°-turned ports of the OMTs. In fact, because of such a configuration, compact housing and symmetrically packaging of microwave source and coupling components is effectively physically impossible.

SUMMARY OF THE INVENTION

In accordance with the present invention, there is provided a new and improved variable ratio power combiner which accomplishes desired microwave energy combining through a simplified component grouping and packaging configuration not attainable by the above-referenced conventional schemes. To this end the variable ratio power combiner of the present invention employs a septum polarizer in place of at least a respective one of the OMTs, together with an associated independently rotatable quarter waveplate or 90° differential phase shifter. Where both OMTs are replaced by respective septum polarizers and associated quarterwave plates, the resulting configuration offers an immediate advantage over the conventional VRPC approach shown in FIG. 1 in that the phase of the transmitters need not be adjusted upstream of the inputs.

In accordance with the present invention, as noted above, the waveguide connection and packaging constraints of the prior art are overcome by a new and improved variable ratio power combiner that employs, as its major coupling component, one or more septum polarizers and associated 90° differential phase shifters or quarter waveplates in place of the OMTs of the above-described conventional schemes. Advantageously, a septum polarizer is a relatively simple component that serves the same function as an OMT and polarizer combination. Because it has an essentially T-shaped configuration, it can bring a pair of waveguide arms together in the same plane back-to-back, so that the resulting power combiner may provide the desired symmetrical coupling. Normally the variable ratio power combiner requires only symmetrical inputs for the sources and not both symmetrical inputs and outputs, so that only a single septum polarizer and associated quarter waveplate are employed, with an OMT used for the output. For a completely symmetrical configuration, however, the other OMT may be replaced by a separate septum polarizer/rotatable quarter waveplate arrangement. The latter configuration avoids the necessity of adjusting the phases of the signal sources upstream of the inputs.

DETAILED DESCRIPTION

Figure 1:
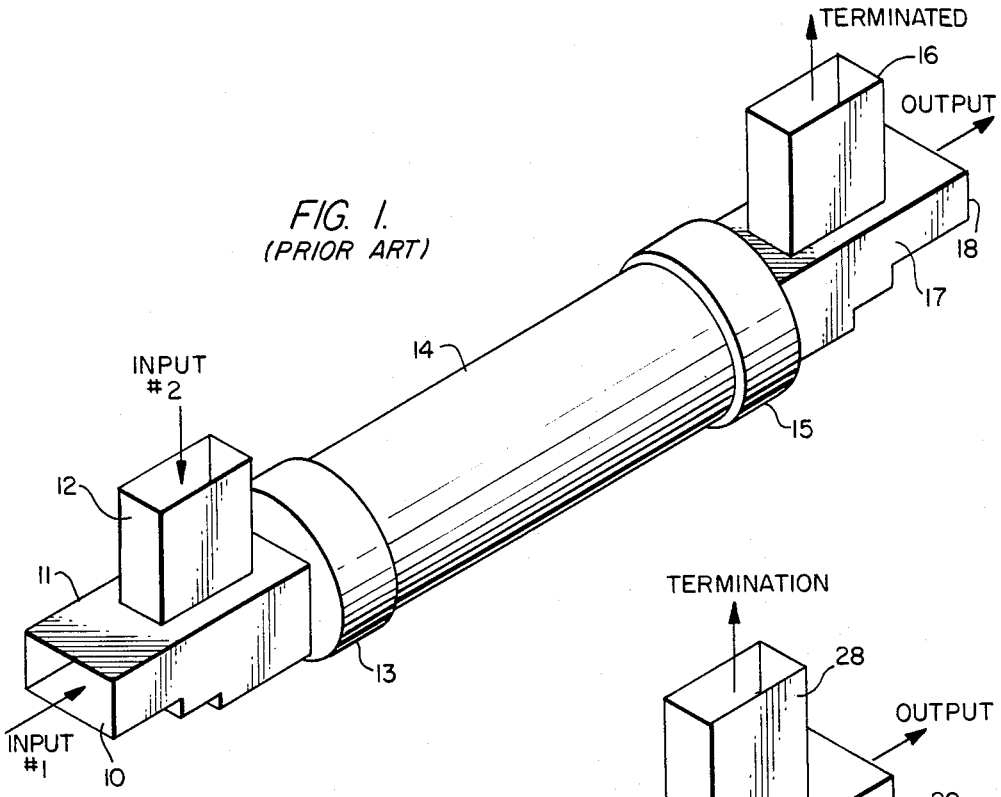
FIG. 1. (PRIOR ART)
FIG. 1 shows a conventional variable ratio power combiner employing orthoganol mode transducers and an associated halfwave plate.
Figure 2:
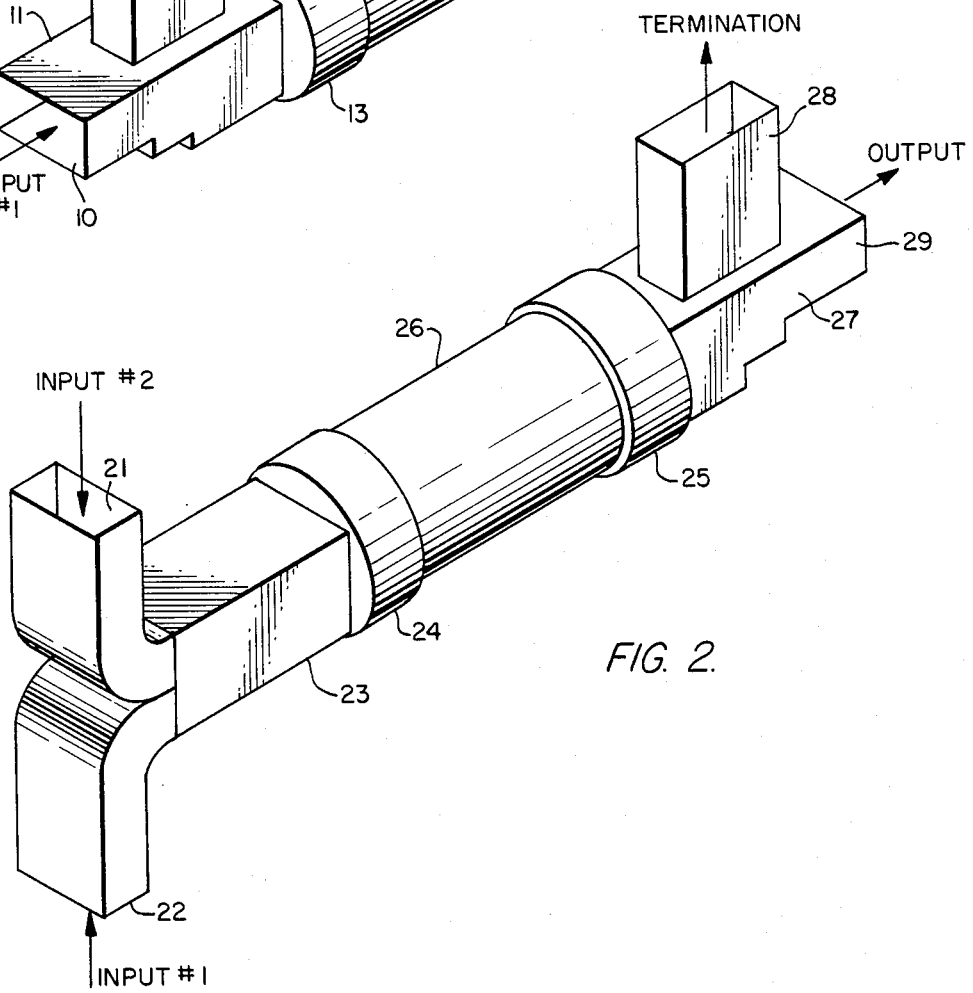
FIG. 2 shows a variable ratio power combiner employing a septum polarizer and associated quarter waveplate in accordance with an embodiment of the present invention.

Referring now to FIG. 2, wherein an illustration of a variable ratio power combiner that permits symmetrical coupling of microwave energy sources in accordance with the present invention is shown, in place of an orthogonal mode transducer, such as orthogonal mode transducer 11 shown in FIG. 1, which does not permit symmetrical coupling of signals from a pair of input sources, a septum polarizer 23 having a pair of T-shaped input ports 21 and 22 is provided. The septum polarizer 23 is coupled through a rotary joint 24 to a quarterwave plate or 90° differential phase shifter 26. The other end of the quarterwave plate or 90° phase shifter is coupled through a rotary joint 25 to an output orthogonal mode transducer 27. Output OMT has a load termination port 28 and an output port 29. As pointed out previously, for a normal power combining operation, the combiner of the present invention needs only to be symmetrically configured at its input end, namely where signal sources are coupled to input ports 21 and 22.

The septum polarizer 23, itself, is a relatively simple component which serves the same function as an OMT and polarizer combination. Septum polarizers, per se, are known in the art and attention may be directed to the embodiments described in the patents to Salzberg U.S. Pat. No. 4,122,406, Gould U.S. Pat. No. 4,126,835 and Rootsey U.S. Pat. No. 3,958,193 for detailed explanations of the same. As described in the above-referenced patent to Rootsey, for example, a septum polarizer of the type employed in the configuration shown in FIG. 2 consists of a pair of waveguide inputs with a common broadwall and a single square waveguide output which carry both senses of circular polarization. The common broadwall is removed at an angle of about 30° to form a septum.

In operation, the polarizer septum operates to split the parallel component forming odd modes in the rectangular ports and a normal component divides and forms even modes in the rectangular ports. There is a 90° differential phase shift between the even and odd mode generation so that for circular polarization within a square waveguide, the odd and even modes will add in a singular rectangular port and will cancel in the other port. The opposite sense of circular polarization will reverse the signals in the output ports.

Employing such a septum polarizer 23 in the configuration of the invention shown in FIG. 2, there is obtained a variable directional coupler which operates as follows. Consider a signal being applied to the output OMT port 29. This signal is linearly polarized as it enters the circular waveguide and, if the quarterwave plate 26 is aligned with this polarization, it will not change its elliplicity as it passes through the septum polarizer 23. This means that the signal will split evenly between the two rectangular ports 21 and 22 of the septum polarizer. If the quarter waveplate 26 is oriented at 45° with respect to the linear signal from the OMT, it will be circularly polarized at the septum polarizer 23 and will be seen at only a single rectangular waveguide port 21 or 22. If the quarter waveplate is rotated minus 45° with respect to the input signal, the sense of circular polarization is reversed and the total energy will be directed at the other of the rectangular ports 21 and 22 of the septum polarizer 23. If the quarterwave plate 26 is rotated at some other angle, the energy will be divided between the septum polarizer rectangular waveguide ports 21 and 22 in accordance with this modified sense of rotation. In all cases, assuming that the ports are well matched, there is no signal at the orthogonal port 28 of the OMT. Now, since the system is reciprocal, then varying the input levels of the correctly phased coherent signals that are applied to input ports 21 and 22 of the septum polarizer will result in a combined output at port 29 of the OMT.

Figure 2A:
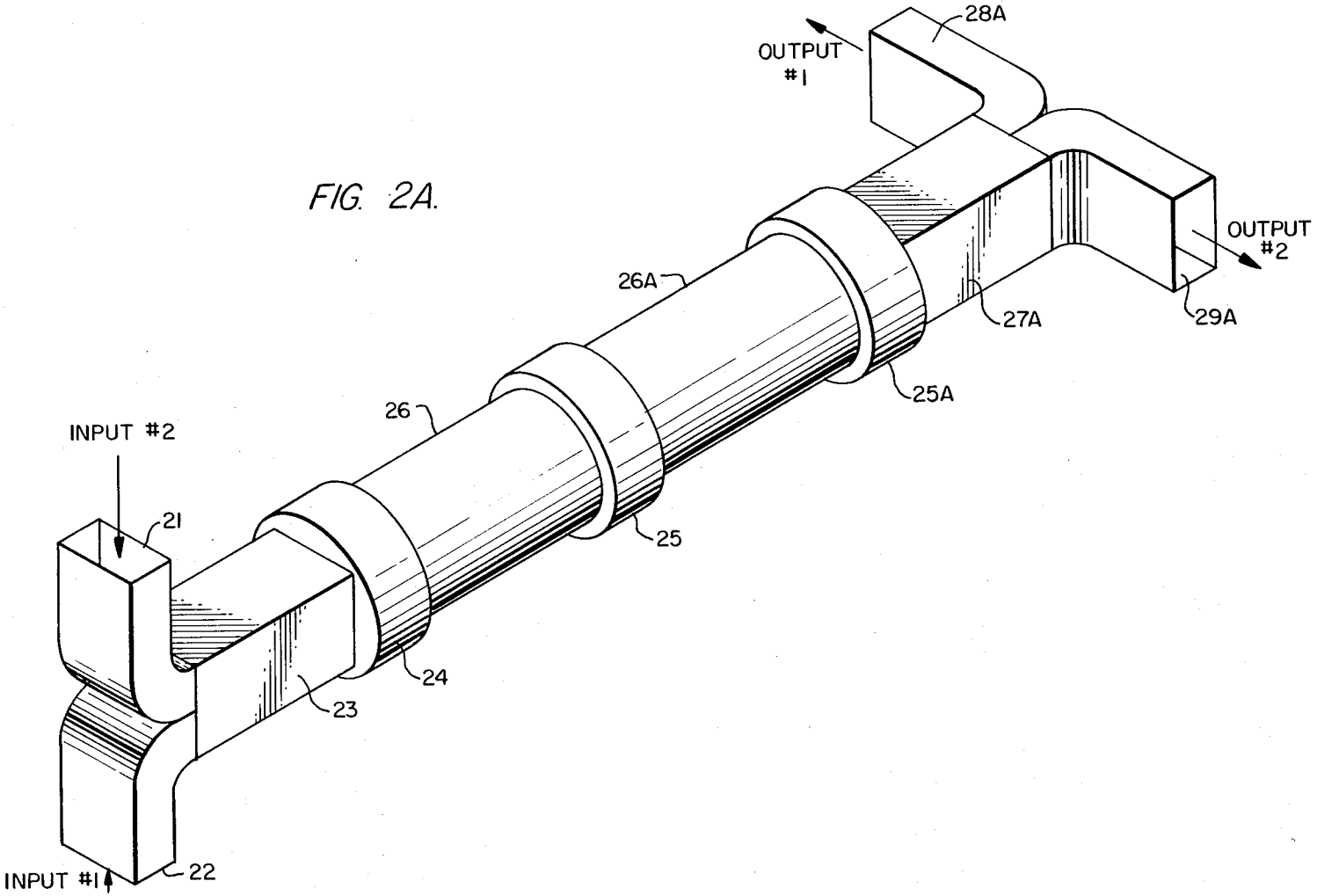
FIG. 2A shows a variable ratio power combiner/distribution configuration employing a pair of septum polarizers and associated quarterwave plates in accordance with another embodiment of the present invention.

FIG. 2A shows a modification of the configuration shown in FIG. 2, in that another septum polarizer and associated quarterwave plate are employed in place of the output OMT. This results in a power combiner/distribution arrangement that is completely symmetrical and obviates the need for adjustment of the phasing of the power sources that are coupled to input ports Nos. 1 and 2. Here, an additional rotatable quarter waveplate 26A is series-coupled, by way of rotary joints 25 and 25A, between rotatable quarterwave plate 26 and septum polarizer 27A. The outputs of septum polarizer 27A are derived from T-shaped waveguide ports 28A and 29A, with phase adjustment of the sources being controlled by rotation of the quarterwave plates of the combiner distribution scheme, thereby controlling the coupling of the combined sources to output ports Nos. 1 and 2.

As pointed out above, because of the physical configuration of the septum polarizer, symmetrical packaging and thereby reduced waveguide run complexity and bulkiness are achieved in accordance with the variable ratio power combiner of the present invention. This is especially significant in today's satellite communications terminals which require the availability of high transmit powers over wide bandwidths.

Figure 3:
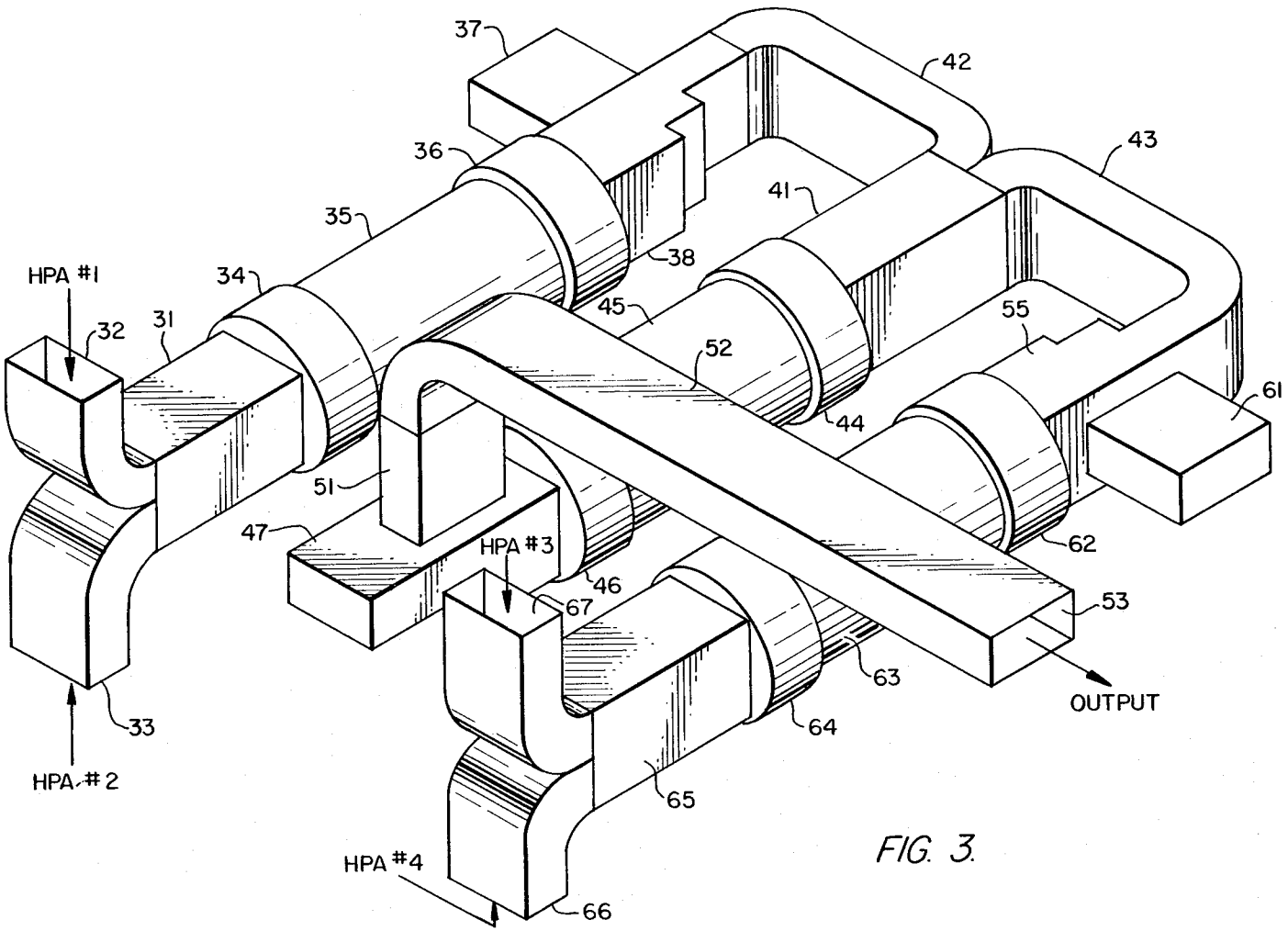
FIG. 3 shows a symmetrical packaging arrangement for coupling the outputs of four microwave energy sources employing the variable ratio power combiner of the present invention.

For example, a typical terminal may utilize a single liquid cooled traveling wave tube amplifier (TWTA) capable of 4 to 8 KW continuous power from 7.9 to 8.4 GHz. In order to eliminate the liquid cooling system which is prone to failure, air cooled TWT amplifiers may be substituted for the liquid cooled amplifiers. However, a single air cooled TWTA will not achieve the total output power required, so that several TWTAs must be combined to form a single highpower output. An arrangement for achieving the combining of the output of a plurality of TWTAs is shown in FIG. 3, which depicts a configuration for combining the outputs of four amplifiers built into two side-by-side racks with a TWTA in the top and bottom of each rack, the combining network of FIG. 3 being sandwiched into the space between them. By utilizing the symmetrical connecting network of the present invention arranged as shown in FIG. 3, the combining network simplifies and enhances packaging of the overall system by reducing line lengths and allowing more room for filters and other components in the limited space available.

More particularly, the arrangement shown in FIG. 3 is comprised of the interconnection of a plurality of the units shown in FIG. 2 for combining four high power amplifier signals at respective ports 32, 33, 66 and 67, to provide an output at output port 53. Between these ports there is provided a trio of variable ratio power combiners each having a configuration shown in FIG. 2 and made of the individual components of the units shown in FIG. 3. For combining inputs at ports 32 and 33, an initial combiner employs a septum polarizer 31 having rotary joints 34 and 36 between which a quarter waveplate 35 is provided. The output OMT 38 has a termination load port 37 and an output port connected through waveguide run 42 which forms an input rectangular port of septum polarizer 41 of a third or output variable ratio power combiner.

A second pair of microwave inputs are supplied to T-configured rectangular input ports 66 and 67 of a septum polarizer 65. Septum polarizer 65 is coupled through rotational joint 64 to a quarter waveplate 63. The quarter waveplate 63, in turn, is coupled through rotational joint 62 to an output OMT 55 having a load termination port 61 and a combined output port that is jointed via microwave rectangular waveguide 43 to a second input port of septum polarizer 41. In this configuration, input port 42 of polarizer 41 contains a combination of input signals IN1 and IN2 while input port 43 of polarizer 41 contains a combination of input signals IN3 and IN4.

These signals, in turn, are combined in the output variable ratio power combiner consisting of septum polarizer 41 and associated coupling circuitry similar to those of the other combiners.

Specifically, septum polarizer 41 is coupled to a quarterwave plate 45 through rotational joint 44. The quarterwave plate 45 is coupled through rotational joint 46 to an output OMT 47, having a load termination port and an output port 51 disposed orthogonally thereto and coupled to waveguide run 52 to an output port 53.

The arrangement shown in FIG. 3 has been employed to illustrate the ability of the invention to provide a compact physical arrangement for a plurality of power combiners due to the symmetrical nature and use of the septum polarizers and the replacement of halfway plate rotaters by quarter waveplate components. This makes the invention especially suitable for present data satellite/antennas environments where both payload and housing area form limiting constraints on the type of system that is permitted to be employed.

While I have shown and described an embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed:

1. A microwave power combiner for combining microwave energy that is coupled to first and second input ports and supplying combined energy to an output port comprising:

a septum polarizer having first and second input ports for receiving microwave energy from first and second sources and an output port;

first waveguide means including a quarterwave plate coupled to the output port of said septum polarizer; and second waveguide means, coupled to said first waveguide means for supplying combined energy therefrom in accordance with the degree of rotation of said quarter waveplate relative to its coupling to the output port of said septum polarizer.

2. A microwave power combiner according to claim 1, wherein said second waveguide means comprises an orthogonal mode transducer having an input port and first and second output ports orthogonally disposed with respect to each other, the input port of said transducer being coupled to said first waveguide means.

3. A microwave power combiner according to claim 2, wherein said septum polarizer comprises first and second waveguide sections first ends of which form the first and second input ports thereof and second ends of which are joined together at a third waveguide section in which a septum is provided to form the output port thereof.

4. A microwave power combiner according to claim 3, wherein said septum polarizer input is T-shaped, with the first and second waveguide sections thereof being joined back-to-back to provide said T-shape and thereby permitting symmetrical coupling of microwave energy sources to said combiner.

5. A microwave power divider for providing controllable amounts of microwave energy at first and second output ports comprising:

an input waveguide adapted to receive linearly polarized microwave energy;

first waveguide means serially coupled to said input waveguide for converting said linearly polarized microwave energy into circularly polarized microwave energy; and symmetrically configured output waveguide transducer means having an input port and a pair of output ports symmetrically disposed with respect to the input port thereof, which input port is coupled to receive circularly polarized microwave energy converted by said first waveguide means, so that at said pair of output ports there are provided respective amounts of microwave energy in accordance with the circular polarization conversion action of said first waveguide means.

6. A microwave power divider according to claim 5, wherein said input waveguide comprises an orthogonal mode transducer.

7. A microwave power divider according to claim 5, wherein said output waveguide transducer means comprises a T-shaped septum polarizer.

8. A microwave power divider according to claim 7, wherein said input waveguide comprises an orthogonal mode transducer.

9. A microwave power divider according to claim 5, wherein said first waveguide means comprises a rotatable quarterwave plate.

10. A microwave power combiner for combining microwave energy that is coupled to first and second input ports and supplying combined energy to an output port comprising:

a symmetrically configured input waveguide transducer means having a pair of input ports symmetrically disposed with respect to an output port thereof, said pair of symmetrically disposed input ports forming the first and second input ports of said power combiner;

first waveguide means serially coupled to the output port of said symmetrically configured input waveguide transducer means for converting circularly polarized microwave energy into linearly polarized microwave energy; and an output waveguide transducer means adapted to receive said linearly polarized microwave energy.

11. A microwave power combiner according to claim 10, wherein said output waveguide transducer means comprises an orthogonal mode transducer.

12. A microwave power combiner according to claim 10, wherein said symmetrically-configured input waveguide transducer means comprises a T-shaped septum polarizer.

13. A microwave power combiner according to claim 10, wherein said first waveguide means comprises a rotatable quarterwave plate.

14. A microwave power combiner according to claim 13, wherein said symmetrically-configured input waveguide transducer means comprises a T-shaped septum polarizer.

15. A microwave power combiner according to claim 14, wherein said output waveguide transducer means comprises an orthogonal mode transducer.

16. A microwave power distribution arrangement for combining microwave energy that is coupled to first and second input ports and selectively distributing combined energy to first and second output ports comprising:

a symmetrically-configured input waveguide transducer means having a pair of input ports symmetrically disposed with respect to an output port thereof, said pair of symmetrically disposed input ports forming the first and second input ports of said arrangement;

first waveguide means serially coupled to the output port of said symmetrically configured input waveguide transducer means for converting circularly microwave energy into linearly polarized microwave energy;

second waveguide means serially coupled to said first waveguide means for converting linearly polarized microwave energy into circularly polarized microwave energy; and a symmetrically-configured output waveguide transducer means having a pair of output ports symmetrically disposed with respect to an input port thereof, said pair of symmetrically disposed output ports forming the first and second output ports of said arrangement, the input port of said symmetrically-configured output waveguide transducer means being coupled to said second waveguide means.

17. A microwave power distribution arrangement according to claim 16, wherein said symmetrically-configured input waveguide transducer means comprises a T-shaped septum polarizer.

18. A microwave power distribution arrangement according to claim 17, wherein said first waveguide means comprises a rotatable quarterwave plate.

19. A microwave power distribution arrangement according to claim 17, wherein said symmetrically-configured output waveguide transducer means comprises a T-shaped septum polarizer.

20. A microwave power distribution arrangement according to claim 19, wherein each of said first and second waveguide means comprises a rotatable quarterwave plate.

21. A microwave power combiner for combining microwave energy that is coupled to first, second, third and fourth input ports and supplying combined energy to an output port comprising:

a plurality of microwave energy combining arrangements each of which includes a symmetrically-configured input waveguide transducer means having a pair of input ports symmetrically disposed with respect to an output port thereof;

first waveguide means serially coupled to the output port of said symmetrically-configured input waveguide transducer means for converting circularly polarized microwave energy into linearly polarized microwave energy; and output waveguide transducer means adapted to receive said linearly polarized microwave energy; and wherein the respective input ports of said ones of said plurality of combining arrangements form said first, second, third and fourth input ports of said power combiner;

the respective output waveguide transducer means of said first and second ones of said plurality of combining arrangements are coupled to the pair of input ports of a third one of said plurality of combining arrangements; and the output waveguide transducer means of said third one of said plurality of combining arrangements is coupled to the output port of said combiner.

22. A microwave power combiner according to claim 21, wherein said output waveguide transducer means comprises an orthogonal mode transducer.

23. A microwave power combiner according to claim 21, wherein said symmetrically-configured input waveguide transducer means comprises a T-shaped septum polarizer.

24. A microwave power combiner according to claim 21, wherein said first waveguide means comprises a rotatable quarterwave plate.

25. A microwave power combiner according to claim 24, wherein said symmetrically-configured input waveguide transducer means comprises a T-shaped septum polarizer.

26. A microwave power combiner according to claim 25, wherein said output waveguide transducer means comprises an orthogonal mode transducer.

* * * * *